US007588079B2

(12) United States Patent
Kluger et al.

(10) Patent No.: US 7,588,079 B2
(45) Date of Patent: Sep. 15, 2009

(54) WELL SCREEN

(75) Inventors: Dieter Adolf Kluger, Singapore (SG); Graeme John Dowsett, Singapore (SG)

(73) Assignee: Completion Products Pte Ltd., Singapore (SG)

( * ) Notice: Subject to any disclaimer, the term of this patent is extended or adjusted under 35 U.S.C. 154(b) by 0 days.

(21) Appl. No.: 10/560,914

(22) PCT Filed: Jun. 16, 2004

(86) PCT No.: PCT/SG2004/000181

§ 371 (c)(1),
(2), (4) Date: Dec. 16, 2005

(87) PCT Pub. No.: WO2004/111384

PCT Pub. Date: Dec. 23, 2004

(65) Prior Publication Data

US 2006/0137883 A1 Jun. 29, 2006

(30) Foreign Application Priority Data

Jun. 17, 2003 (SG) ..... 200303719-9

(51) Int. Cl.
*E21B 43/38* (2006.01)

(52) U.S. Cl. ..... 166/236; 166/228

(58) Field of Classification Search ..... 166/228, 166/230, 234, 236; 210/484
See application file for complete search history.

(56) References Cited

U.S. PATENT DOCUMENTS

| | | | | |
|---|---|---|---|---|
| 4,314,129 | A * | 2/1982 | Wilson et al. | 219/58 |
| 5,232,048 | A | 8/1993 | Whitebay et al. | |
| 5,782,299 | A * | 7/1998 | Simone et al. | 166/230 |
| 5,849,188 | A * | 12/1998 | Voll et al. | 210/497.01 |
| 6,158,507 | A * | 12/2000 | Rouse et al. | 166/228 |
| 6,305,468 | B1 * | 10/2001 | Broome et al. | 166/233 |
| 6,715,544 | B2 * | 4/2004 | Gillespie et al. | 166/230 |
| 2002/0178582 | A1 * | 12/2002 | Echols et al. | 29/896.61 |
| 2003/0021922 | A1 * | 1/2003 | Bode | 428/34.4 |

FOREIGN PATENT DOCUMENTS

| | | |
|---|---|---|
| WO | WO 02/27138 A2 | 4/2002 |
| WO | WO 02/42604 A1 | 5/2002 |

* cited by examiner

*Primary Examiner*—Jennifer H Gay
*Assistant Examiner*—Daniel P Stephenson
(74) *Attorney, Agent, or Firm*—Boyle Fredrickson, S.C.

(57) ABSTRACT

A well screen (10) is proposed having an outer standoff layer (14) between the protective screen (15) and the filter medium (13). A method of making the well screen (10) is also proposed, comprising a step of pulling an open-ended cylinder of filter medium (13) over underlying layers (12) in the well screen (10). Furthermore, a method is proposed using series resistance welding for sealing seams in the layers making up the well screen (10).

13 Claims, 5 Drawing Sheets

WELL SCREEN

FIELD OF THE INVENTION

The present invention relates to a well screen for filtering fluids drawn from wells, and to a method of its manufacture.

BACKGROUND OF INVENTION

The extraction of fluids such as oil, gas or water from subterranean wells involves introducing a transportation pipe into the ground. The fluid is forced to the surface of the earth through the pipe by natural pressure in the well, a pump aboveground, or displacing the fluid with another fluid, such as using water to displace oil. Such a process involves a flow of highly pressurised fluid into the pipe which inevitably carries along with it debris in the form of sand, stones and other particles, which erodes the welling machinery. Therefore, it is a common practice to provide a filter assembly, known as a well screen, at the submerged opening of the transportation pipe to separate the fluid from the solids.

An available design of well screen, comprises firstly a length of perforated pipe known as a base pipe. The transportation pipe is connected at its submerged end to the base pipe. The perforations along the side of the base pipe allow the fluid to enter into the transportation pipe. Generally, it is desirable that the base pipe has as large a diameter as possible, subject to physical and efficiency constraints.

The base pipe is essentially encased in an outer layer of screen, which filters the fluid flowing into the base pipe. The layer of filter medium has fine openings, and therefore a large percentage of open area. Some types of filter medium are easily damaged as they are woven of fine metal threads, which are eroded by the particles carried by the strong fluid flow. They are also easily clogged, creating localised areas of blockage which eventually build up.

Conventionally, the filter medium is wrapped tightly around the base pipe. However, it is also proposed in the art to provide a gap between the base pipe and the filter medium, as shown in US 2002/0038707 to allow the fluid to flow past clogged areas on the filter medium and enter though unclogged adjacent areas.

Many inventions have been proposed to improve the efficiency and life spans of well screens. For example, U.S. Pat. No. 5,611,399 is concerned with fabricating a filter assembly without using welds on the filter material, since such welded seams can create areas of weakness. A base pipe with openings is disclosed, upon which is mounted a coarse screen having a series of longitudinally extending support members tied together with a wound wire which can be a series of rings. On the coarse screen is disposed a fine screen which is held by crimping. A perforated outer shroud covers the fine screen as a protective screen. The screens are put through a die in order to compress and hold these elements onto end caps.

U.S. Pat. No. 6,305,468 provides an improvement on U.S. Pat. No. 5,611,399 and is also concerned with fabricating a filter assembly without using welds on the filter material which can create areas of weakness. The method of securing the filter material is different from U.S. Pat. No. 5,611,399 and the outer shroud is also put through the die with the claimed advantage of the latter design being that the close-fit nature of the components, particularly the outer shroud and the filter material, allows the assembly to withstand significantly greater differential pressure than the constructions of prior designs such as illustrated in U.S. Pat. No. 5,611,399.

U.S. Pat. No. 6,158,507 discloses a rod-base screen with two filter layers and an outer shroud 34. The method of preparing the rod-based screen is disclosed in U.S. Pat. No. 4,314,129.

U.S. Pat. No. 4,314,129, uses a resistance welding technique to secure a spirally wound rod along a circumferential spread of longitudinal rods, the longitudinal rods running parallel along the length of the base pipe.

US Application 2002/0038707 noted above further describes a spirally-wrapped wire used to create a space between the filter and the base pipe, such that the gap between the filter medium and the base pipe is maintained. This gap prevents blockage on the surface of the base pipe in the event that the filter medium were pressed towards the base pipe.

U.S. Pat. Nos. 5,782,299 and 6,109,349 disclose a filter layer and a protective screen, which can be disposed inside or outside the filter. The protective screens are, in turn, made up of two layers of perforated stainless steel joined together. The layers are relatively thin (0.02-0.13 inch) and thus, relatively speaking, have little structural rigidity. The perforations of the two layers are mis-aligned in such a way that the fluid entering into the filter assembly cannot flow in a direct flow path, and therefore the pressure of the impingement of particles and fluid onto the fine filter mesh is reduced. The deflection is meant to reduce the direct impingement of the fluid against the filter medium.

U.S. Pat. No. 5,849,188 discloses a perforated pipe having an inner jacket closely wound on the pipe, a woven wire mesh layer and a protective jacket. The woven mesh layer is of a type known as twilled Dutch weave which, it is claimed, allows the mesh to remain relatively unclogged even when particles accumulate on the surface of the mesh.

SUMMARY OF THE INVENTION

The present invention aims to provide an improved well screen and/or provide the general public with a useful choice.

In general terms, the invention discloses a well screen which can withstand the collapse of an outer protective screen, in that a gap between a filter medium and the protective screen is maintained by an outer standoff layer. The gap ensures the existence of flow paths across the surface of the filter medium, as well as flow paths through the filter medium. The invention also proposes the use of a pre-welded mesh which could be wrapped around a base pipe before being secured in place. The invention also proposes the use of a series resistance welding technique, wherein the electrodes are placed next to each other on the same surface to be welded, instead of on opposite sides. This technique makes welding the sides of a flat sheet to form a cylinder possible without the difficulty of positioning one electrode within the cylinder and one without.

According to the invention in a first aspect, there is provided a well screen comprising a filter layer; an outer standoff layer around the filter layer; and a cover around the outer stand-off layer; wherein the outer stand-off layer is arranged to space the cover from the filter layer and resist collapse of the cover towards the filter layer.

According to the invention in second aspect there is provided a well screen comprising a filter layer, a cylindrical skeletal layer around the filter layer; and a cover around the skeletal layer; wherein the skeletal layer spaces the cover from the filter layer.

According to the invention in a third aspect, there is provided a method of forming a standoff layer in a well screen comprising the steps of providing a pre-fabricated mesh, wrapping the mesh around at least one underlying member of the well screen and connecting together the longitudinal edges of the mesh.

According to the described embodiment, there is provided a method of forming a filter layer for a well screen comprising the steps of forming a sheet of woven mesh into a hollow cylindrical form and connecting longitudinal edges of the sheet together by resistance welding.

According to the invention in a fourth aspect, there is provided a well screen comprising a base pipe; an inner stand-off layer; a filter layer covering the inner stand-off layer; an outer stand-off layer around the filter layer; and a cover around the outer stand-off layer.

According to the invention in a fifth aspect, there is provided a well screen comprising: a filter layer; an outer stand-off layer which provides a cage for and/or is of greater rigidity than the filter layer; and a cover around the outer stand-off layer.

BRIEF DESCRIPTION OF THE FIGURES

Preferred features of the invention will now be described, for the sake of illustration only, with reference to the following figures in which.

DETAILED DESCRIPTION OF THE EMBODIMENTS

Figure 1:
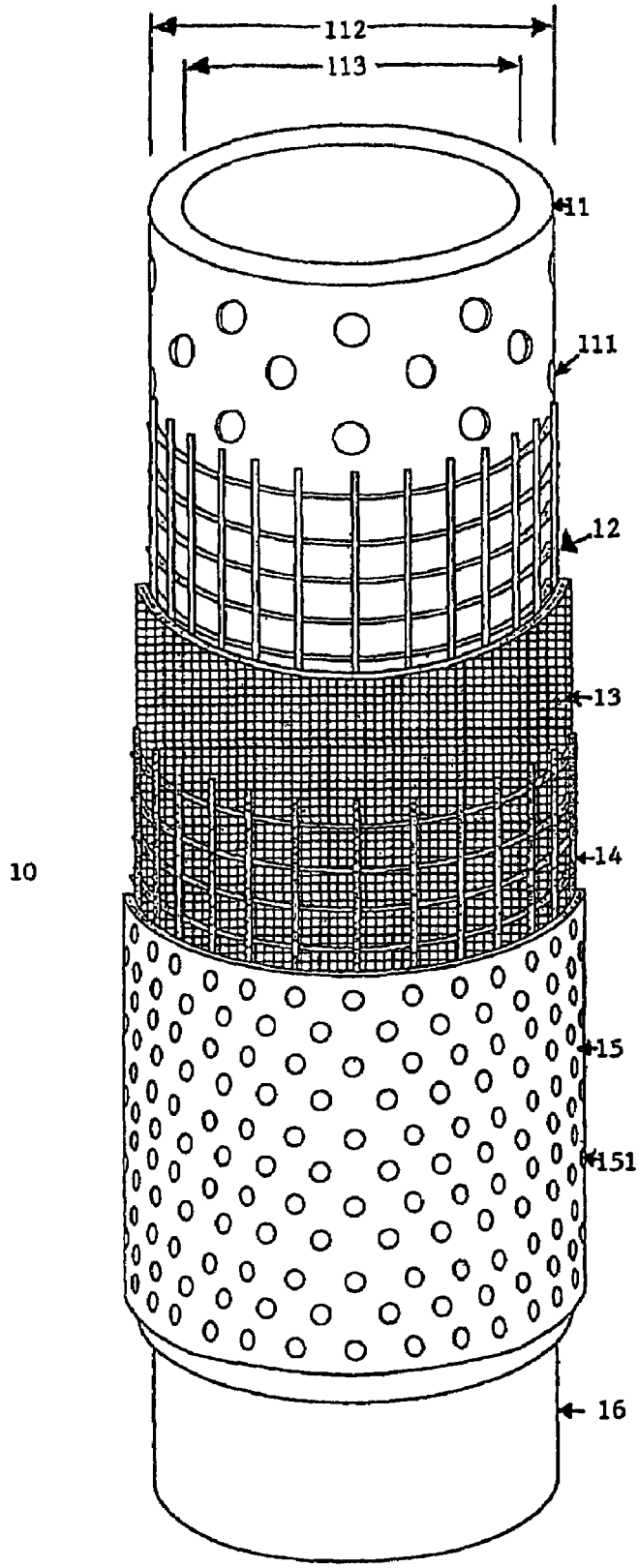
FIG. 1 illustrates a cut-away sectional perspective view of a well screen according to one embodiment of the invention.

FIG. 1 shows one end of a well screen 10 according to an embodiment of the invention, comprising a base pipe 11, a cylinder of mesh being an inner standoff layer 12, a cylinder of mesh being a filter medium 13, a cylinder of mesh being an outer standoff layer 14, aa cylinder of perforated metal sheet being a protective cover 15 and a weld ring 16. Only one end of the well screen is illustrated in FIG. 1, the other end of the well screen 10 being the same as what is shown.

The base pipe 11 has holes 111 through which fluid may flow into an axially disposed transportation pipe (not shown). The holes 111 make up a total open area of 15 to 30% on the side of pipe 11. Industrial standards usually specify that it's the pipe has an outer diameter of 2.375" to 7".

The inner standoff layer 12 is preferably made up of mesh of orthogonally disposed metal rods welded together. The mesh is pre-formed as a flat sheet and is cut to size and wrapped and pulled tightly around the base pipe 11, typically using a series of strap wrenches having straps of flexible material with a tightening mechanism, which can be wrapped around the mesh and then tightened, pulling the mesh tightly around the base pipe. The two longitudinal sides of the mesh sheet are then welded to each other to form a cylindrical mesh 12 tightly embracing the base pipe 11. The mesh 12 therefore provides a rigid skeletal structure, which ensures a consistent gap between a filter medium 13 and the outer diameter 112 of the base pipe 11. The gap enhances flow distribution through the filter medium 13. The welding technique used is preferably series resistance welding.

The filter medium 13 comprises typically two sub-layers of wire mesh (not illustrated) which are sintered together to form a strong single bonded layer providing fine filtration functions. Each sub-layer of the wire mesh is a commercially available material. The material used could be a stainless steel such as Grade 316 or Alloy 20. The quality of these meshes is controlled by several international standards, for example, "plain square weave", "plain Dutch weave", "twill Dutch weave" and so on. The filter medium layer 13 is formed into a cylinder from a flat sheet of filter medium before being pulled over the base pipe 11 and the inner standoff layer 12.

The specification of the outer sub-layer (i.e. the size of the openings between the wires) is determined based on the expected size distribution of particles contained in the well. Due to the fine wire size and the large openings required (around 80-300 microns), this outer sub-layer is relatively delicate given the stress it has to withstand in a pressurised well. Hence, a common technique to improve the strength of the outer sub-layer is to provide a mechanical support by sintering one or more sub-layer of mesh underneath. The inner sub-layer of woven mesh is constructed from wires with a larger diameter and with larger apertures or openings between the weaves. The two sub-layers are sintered together by compressing them together at a certain pressure and raising the temperature to just below melting point. The resultant sintered filter medium 13 has both the filtering property of the outer sub-layer of mesh and strength provided by the combination of the two sub-layers. The sintered filter medium 13 is then rolled into a cylinder, typically 1200 mm long. The overlapping sides are resistance welded together to form a longitudinal seam.

The resistance welding technique employed in this embodiment is preferably series resistance welding, which addresses the problem of electrode positioning within a cylindrical structure. Successful application of resistance welding provides significant cost savings and consistent weld quality, as compared to other welding and joining techniques.

When it is desired that two or more cylindrical filter medium 13 are joined together to form a single longer filter medium 13, filter medium 13 cylinders are joined circumferentially end-to-end by the same series resistance welding technique.

The outer standoff layer 14 is preferably more rigid than the filter medium 13 and the protective cover 15 either by choice of material, structure or both, and is preferably constructed from a mesh formed from orthogonally disposed rods welded together. The outer standoff layer 14 ensures an adequate distance, preferably 2.5 to 3 mm, between the filter medium 13 and the protective cover 15, thus enhancing the flow distribution through the filter medium 13. The outer standoff layer is firstly pulled tight around the filter medium 13 (including, naturally, all the layers beneath the filter medium 13) by strap wrenches as described below with regard to the inner standoff layer. If the mesh is metallic, the two adjoining axial edges of the outer standoff layer 14 are resistance welded together along their longitudinal joints and circumferential joints to form a rigid skeletal structure. The skeletal structure prevents direct contact between the protective cover 15 and the filter layer 13. In the event that the protective cover 15 collapses or is deformed due to the force of pressurised fluid flow or collisions with the bore wall of the well during the lowering of the well screen, the gap between the protective screen 15 and the filter medium 13 would be maintained by the outer standoff layer 14. In this way, disturbance to the flow characteristic across the filter medium is minimised, by retaining unobstructed flow paths through the filter medium 13, which would have otherwise been blocked by contact between the protective screen 15 and the filter medium 12. The outer standoff layer 14 also provides greater mechanical strength in a well screen compared to the prior art, and specifically provides comparatively high resistance to rises in back pressure and thus provides high burst strength since layer 14 forms a welded "cage" enclosing the filter medium to hold the filter medium firmly around the inner standoff layer 12 and base pipe 11.

The protective cover 15 of the first embodiment, which is typically made by welding a flat sheet into a tube in a spiral manner, is slid over the outer standoff layer 14. Generally, it has perforations of ¼" to ½" in diameter 151 which provides adequate open area of 15% to 30% through which fluid may flow.

The weld ring 16 is used to join the inner standoff layer 12, filter medium 13, outer standoff layer 14 and the protective cover 15 to the base pipe 11. Therefore the ends of all the layers are sealed, such that fluid entering into base pipe 11 must flow through all the layers and not around the ends. There are weld rings 16 on both ends of a well screen 10 and these are welded to the well screen components. It is possible that there are more than one well screen along a long base pipe, in which case each well screen will still have two weld rings.

Figure 2:
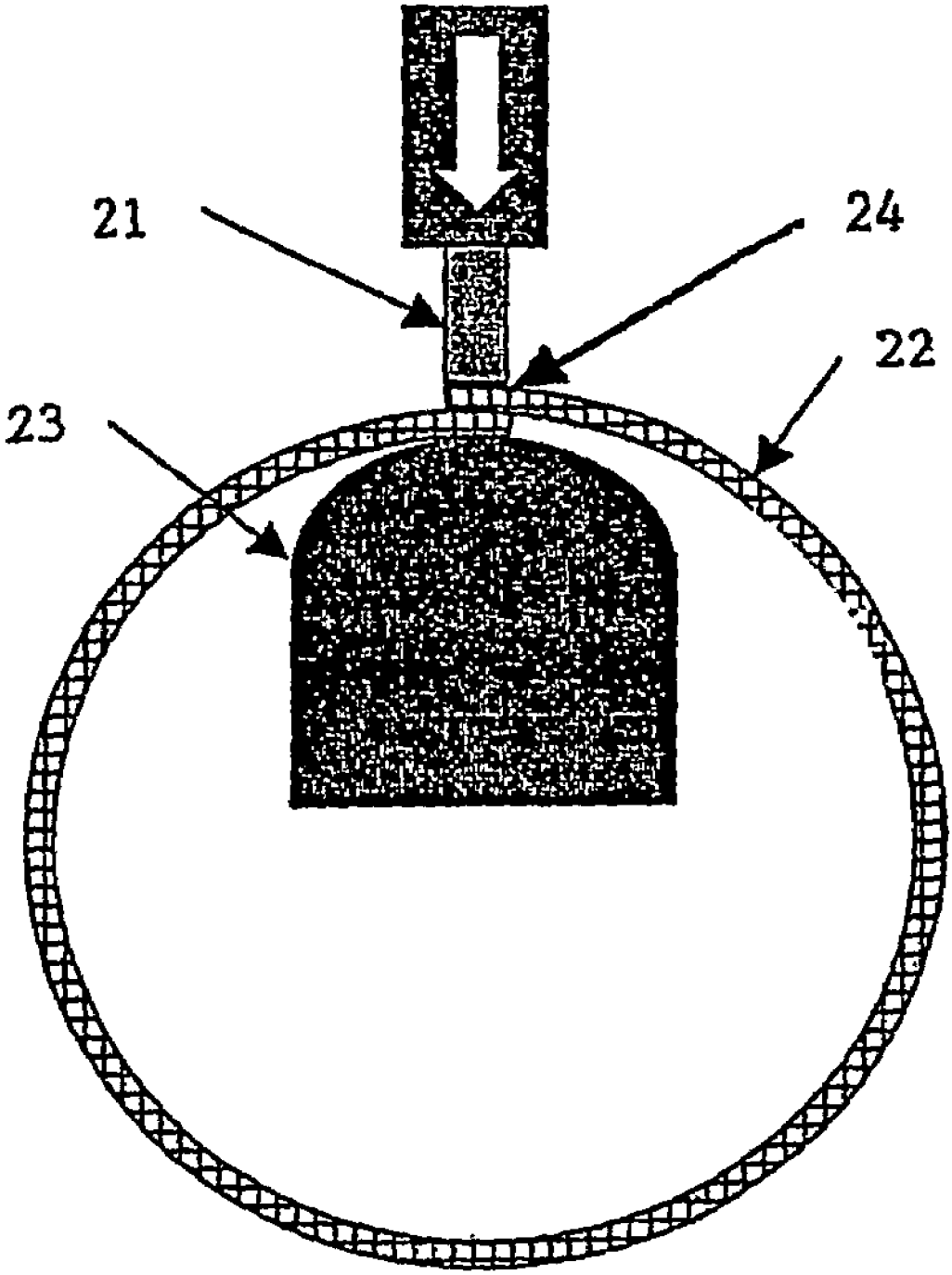
FIG. 2 illustrates an embodiment of the invention which is a method of welding a filter mesh of the well screen as shown in FIG. 1 using a series resistance welding technique.

FIG. 2 shows a side view of a type of resistance welding process, known as series resistance welding, which is used to weld the layers of the well screen into cylindrical shapes if the material is metallic. For example, the flat sheet forming the filter medium 13 is first rolled into a cylinder and placed into a seam welding fixture, with sides of the filter medium sheet along the length of the cylinder overlapping in a region 24. The amount of overlap, a process variable, is approximately 5 mm. The seam is supported by a support member 23 against which the electrodes 21 press. The support member 23 may be sized such that its diameter is less than or equal to the inner diameter of the cylindrical shaped product. The support member 23 may be made of any material such as polymer or metal, but typically copper.

Figure 3:
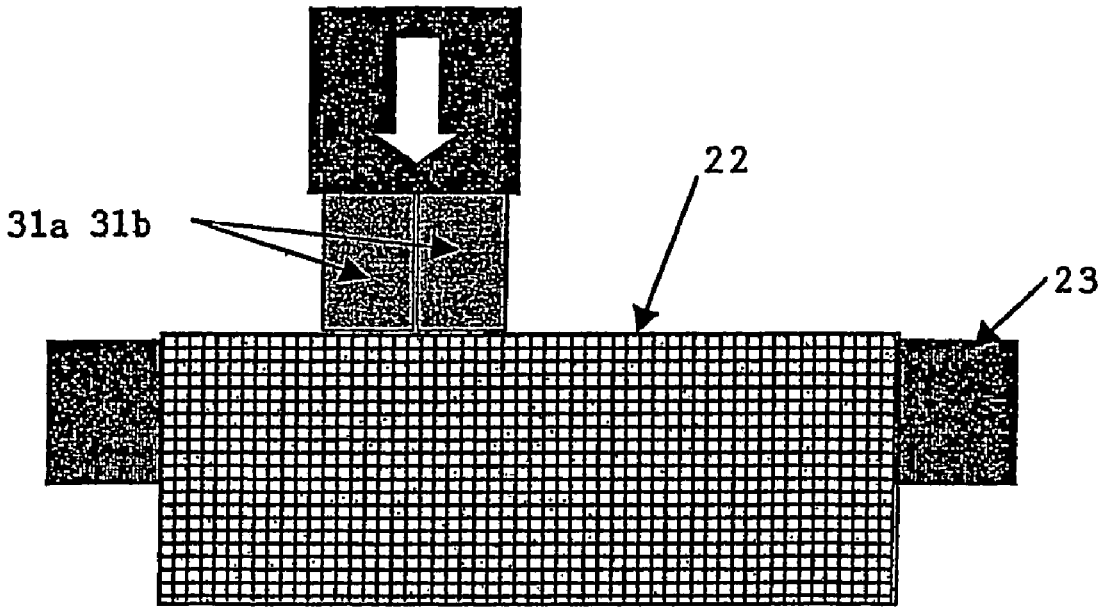
FIG. 3 illustrates the method of FIG. 2 viewed from the longitudinal side of the well screen.

Instead of having electrodes placed on the opposite sides of the overlap 24 (as in a typical resistance welding process) the electrodes 21 (which are made up of electrodes 31*a*, 31*b* as seen in FIG. 3) are placed side by side, but without contact so as to prevent a short circuit.

FIG. 3 illustrates the series resistance welding process viewed from the longitudinal side of the filter mesh 13. The current flows from one electrode 31*a* in contact with the external flap of the overlapping mesh material 24, through the mesh material, and into the other electrode 31*b* which is also in contact with the same external flap of the overlap 24. A support member 23 underneath the overlap 24 allows pressing of the electrodes against the overlap 24. Typically, the series resistance welding welds a length of 4 mm each time. The longitudinal seam of the filter medium 322 cylinder is formed by repetitions of series resistance welding of spots on the overlap 24, along the entire length of the cylindrical mesh filter 22. The seam is largely flattened by pressure applied during the welding.

Figure 4:
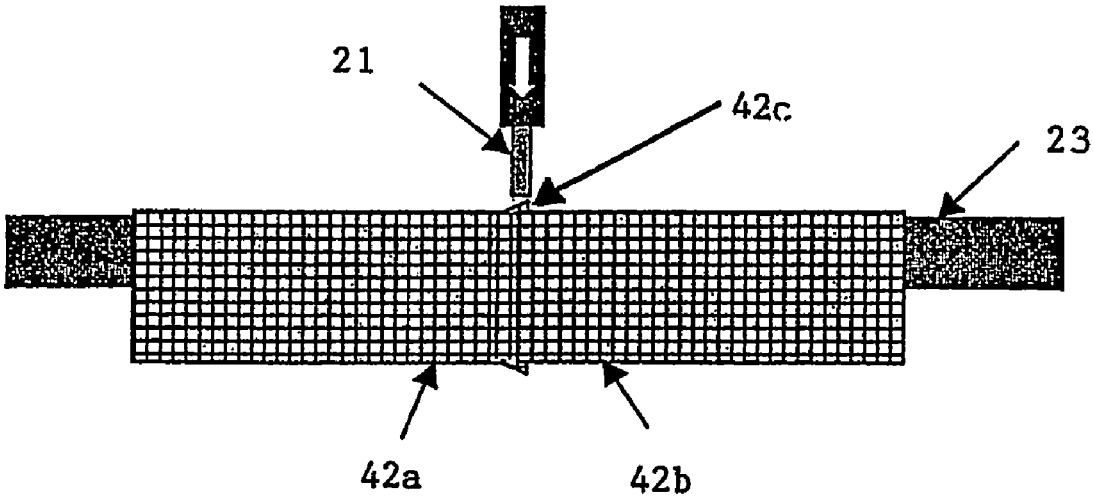
FIG. 4 illustrates a method of welding the ends of two filter meshes of FIGS. 2 and 3 together.
Figure 5:
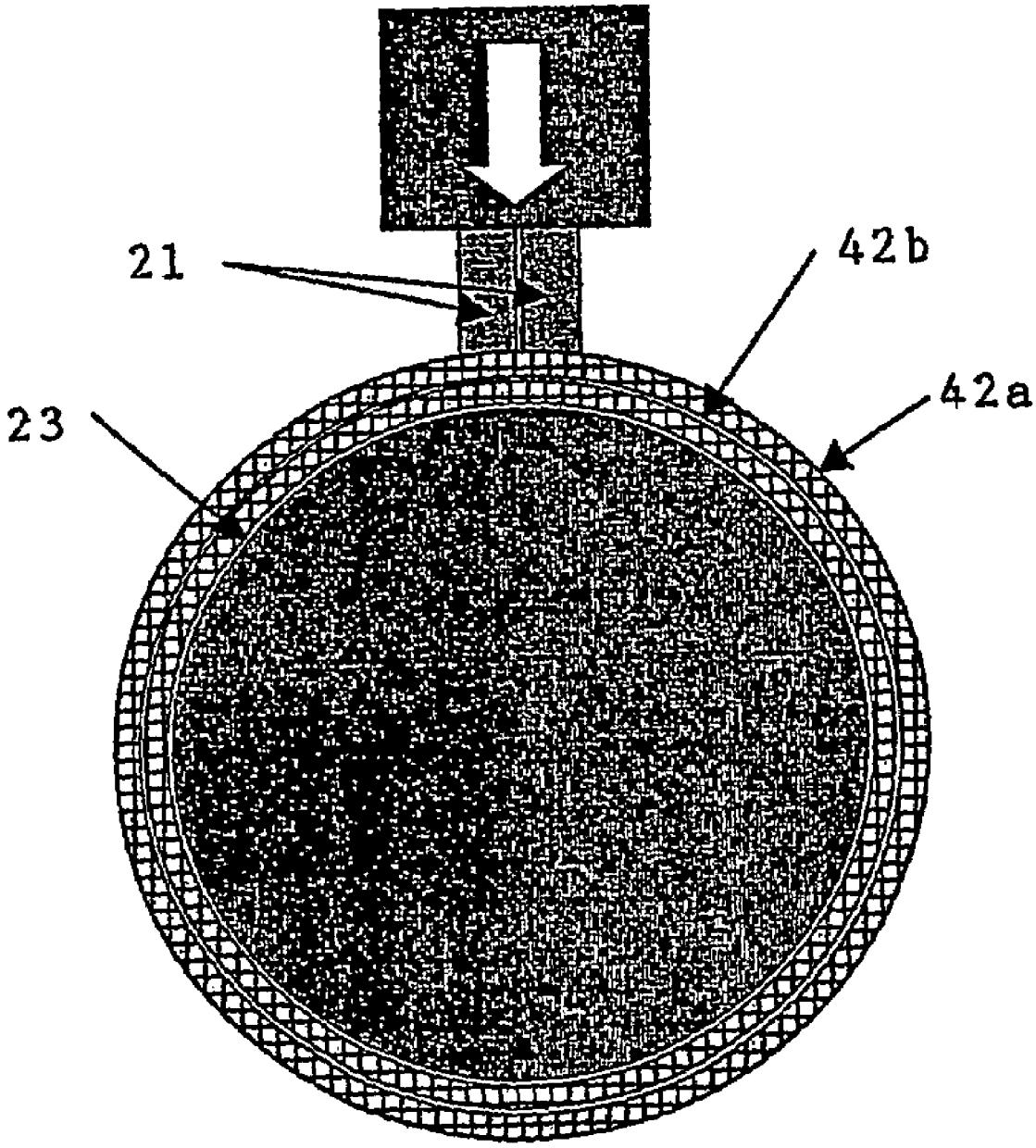
FIG. 5 illustrates the method of FIG. 3 viewed from the longitudinal side of the well screen.

A cylinder of filter medium 12 is usually 4' long. If a longer length is required, several cylinders may be join end-to-end, by arranging the cylinders end-to-end into a long cylinder, and resistance welding them together. FIG. 4 illustrates how two filter medium may be joined together, viewed from length-wise. Two cylinders of filter mesh 42*a* 42*b* are swaged one into the other, forming an overlap 42*c*. The electrodes 21 press onto the overlap 42*c* of the two cylinders, against an internal support member 23. Referring to FIG. 5, a cross-sectional view illustrates how the two layers of filter mesh 42*a* 42*b* are supported from within the cylinders by support member 23, and the electrodes 21 pressing on the layers 42*a* 42*b* when conducting a current through the overlapping layers 42*c*.

A long cylinder of several cylinders of welded mesh is eventually formed, and the two ends of the combined cylinder are joined to the weld rings, also by welding.

Although the embodiment provides for a well screen which is made up of parts as described in the Figures, other embodiments are envisaged. For example, instead of a metal mesh forming the outer standoff layer 14, it can be another material which provides sustainable a gap between the protective cover 15 and the filter medium 13, such as a strong polymer, which may be wrapped around the pipe in a similar way to that described and secured by any suitable means such as adhesive. Instead of a flat welded mesh, other structures may be employed which maintain a gap between the protective cover and the filter medium. For example, two sheets having a plurality of openings, the sheets sandwiching a plurality of spacing pillars, or a single sheet having a plurality of radial projections disposed between openings may be employed, in both cases the pillars/projections being disposed on connected islands between the openings of each sheet. Alternatively, parallel rods spread around the circumference of the filter medium and welded along the length of the filter medium 13 or a series of rings spread and tightened over (or welded to) the filter medium 13, or a thick metal thread running helically and tightly around the circumference and along the length of filter medium, or an embossed contoured and perforated layer may be employed.

A second purpose of the outer standoff layer is to provide a strong structural support to the filter medium 13 in the event of back pressure pushing from the inside of the base pipe outwards against the filter medium. This ensures that the filter medium of the present invention has a longer life span compared to filter medium in conventional well screens.

The application of a resistance welding technique in well screen manufacture that maintains the integrity of the mesh and provides for more consistent seams in the cylindrical layers than those formed by welding techniques usually employed in well screen manufacture, such as TIG welding which tend to damage the mesh and leave weak points where tearing may result under the shearing flow in an oil well.

Although the well screens according to the invention are principally intended for use in oil wells, the well screens are applicable to wells of other fluids, such as natural gas and water etc.

The invention claimed is:

1. A well screen comprising:

a filter layer;

a cylindrical outer stand-off layer around the filter layer, the cylindrical outer stand-off layer having a construction which is more rigid than a construction of the filter layer; and a collapsible outer cover around the outer stand-off layer, said collapsible outer cover having a construction which is less rigid than the construction of the outer stand-off layer;

wherein the outer stand-off layer is arranged to space the collapsible outer cover from the filter layer and is arranged to resist collapse of the cover towards the filter layer.

2. The well screen of claim 1 wherein the outer stand-off layer is a skeletal mesh.

3. The well screen of claim 1 further comprising an inner stand-off layer covered by the filter layer.

4. The well screen of claim 3 wherein the inner stand-off layer is a skeletal mesh.

5. The well screen of claim 1, wherein the cylindrical outer stand-off layer is constructed from a mesh formed from orthogonally disposed rods welded together.

6. The well screen of claim 5, wherein the cylindrical outer stand-off layer is arranged to provide a distance of between 2.5 mm to 3 mm between the filter layer and the collapsible outer cover.

7. The well screen of claim 1, wherein the collapsible outer cover comprises a tube of perforated metal sheet.

8. A well screen comprising:

a filter layer;

a cylindrical skeletal layer around the filter layer, the cylindrical outer stand-off layer having a construction which is more rigid than a construction of the filter layer; and a collapsible outer cover around the skeletal layer, said collapsible outer cover having a construction which is less rigid than the construction of the outer stand-off layer; and wherein the skeletal layer is arranged to space the cover from the filter layer and provide structural resistance against collapse of the collapsible outer cover towards the filter layer.

9. A method of forming a well screen having a standoff layer, the method comprising the steps of:

forming the stand-off layer by wrapping a pre-fabricated mesh around at least one underlying member of the well screen; and connecting together longitudinal edges of the mesh; and wherein the method further comprises:

enclosing a filter layer with the stand-off layer, the stand-off layer having a construction which is more rigid than a construction of the filter layer; and enclosing the stand-off layer with a collapsible outer cover, said collapsible outer cover having a construction which is less rigid than the construction of the stand-off layer.

10. The method of claim 9 wherein the stand-off layer is enclosed by a filter layer.

11. The method of claim 9, wherein the collapsible outer cover comprises a tube of perforated metal sheet.

12. A well screen comprising:

a base pipe;

an inner stand-off layer;

a filter layer covering the inner stand-off layer;

a cylindrical outer standoff layer around the filter layer, the cylindrical outer stand-off layer having a construction which is more rigid than a construction of the filter layer; and a collapsible outer cover around the outer stand-off layer, said collapsible outer cover having a construction which is less rigid than the construction of the outer stand-off layer;

the outer stand-off layer spacing the filter layer from the collapsible outer cover to provide structural resistance against the collapse of the collapsible outer cover towards the filter layer.

13. A well screen comprising:

a filter layer;

a cylindrical outer stand-off layer which provides a cage for and is of greater rigidity than the filter layer; and a collapsible outer cover around the outer stand-off layer, said collapsible outer cover having a construction which is less rigid than the construction of the outer stand-off layer;

the outer stand-off layer spacing the filter layer from the collapsible outer cover to provide structural resistance against the collapse of the collapsible outer cover towards the filter layer.

* * * * *